US005108820A

United States Patent [19]

Kaneko et al.

[11] Patent Number: 5,108,820

[45] Date of Patent: Apr. 28, 1992

[54] SOFT NONWOVEN FABRIC OF FILAMENTS

[75] Inventors: Akira Kaneko; Yoshinori Kobayashi; Katsuya Hata, all of Yamaguchi, Japan

[73] Assignee: Mitsui Petrochemical Industries, Ltd., Tokyo, Japan

[21] Appl. No.: 512,275

[22] Filed: Apr. 20, 1990

[30] Foreign Application Priority Data

Apr. 25, 1989 [JP] Japan ..... 1-104980

[51] Int. Cl.[5] ..... A61F 13/46; D04H 3/14

[52] U.S. Cl. ..... 428/198; 428/74; 428/77; 428/288; 428/296; 428/370; 428/374; 604/378

[58] Field of Search ..... 428/198, 288, 296, 370, 428/374

[56] References Cited

U.S. PATENT DOCUMENTS 3,900,678 8/1975 Aishima et al. ..... 428/374

4,211,819 7/1980 Kunimune et al. .

FOREIGN PATENT DOCUMENTS 1134924 11/1968 United Kingdom .

*Primary Examiner*—James C. Cannon

*Attorney, Agent, or Firm*—Sherman and Shalloway

[57] ABSTRACT

Nonwoven fabrics formed, in spun-bonding process, of crimped bi-component composite filaments composed of (A) a first component composed of (a) 3 to 40% by weight of a propylene/ethylene random copolymer having a melting point, determined from DSC main peaks of 110° to 150° C. and a melt flow rate [ASTM D-1238 (L)] of not more than 15 g/10 minutes and (b) 97 to 60% by weight of polyethylene having a melt flow rate [ASTM-D-1238 (E)] of at least 15 g/10 minutes, and (B) a second component comprising crystalline polypropylene having a melt flow rate [ASTM D-1238 (L)] of at least 10 g/10 min. as a main component, have a soft feel and are suitable for use as, e.g., disposable bed sheets and liners for diapers.

2 Claims, 1 Drawing Sheet

SOFT NONWOVEN FABRIC OF FILAMENTS

This invention relates to a soft nonwoven fabric of filaments, and more specifically, to a nonwoven fabric of filaments having an excellent softness value per unit weight which can be produced by high-speed take-up melt-spinning.

A spun-bonded nonwoven fabric obtained by preparing a nonwoven web directly from spun filaments has higher productivity than other dry-method nonwoven fabrics or wet-method nonwoven fabrics, and excellent mechanical properties such as tensile strength because it is made of continuous filaments, and therefore finds extensive use in various everyday sundry goods and industrial materials.

Since spun-bonded nonwoven fabrics made from polyolefins generally have higher softness than spun-bonded nonwoven fabrics made from polyamides such as nylon, or those made from polyesters such as polyethylene terephthalate, the polyolefin spun-bonded nonwoven fabrics are now finding applications as sheets or top sheets of disposable diapers.

No spun-bonded nonwoven fabric which has sufficient suppleness as is desired in applications in which they make direct contact with a human skin has so far been available.

To improve on this point, nonwoven fabrics of filaments having softness as a result of crimping the filaments have been suggested. Bi-component spun-bonded nonwoven fabrics have been proposed as nonwoven fabrics in which the filaments are crimped. In this type of nonwoven fabrics, the filaments are made from two components align side by side, and are crimped by the difference in shrinkage. Specifically, a nonwoven fabric made from filaments of polypropylene and high-density polyethylene filaments aligned side by side are known (see, for example, Japanese Laid-Open Patent Publication No. 282351/1988).

However, such conventional nonwoven fabrics composed of bi-component filaments have insufficient softness because the number of crimps imparted to the filaments is small. No resin composition has been known which can be stably spun at a take-up speed of more than 2,000 meter/min. by high-speed gaseous stream drafting and can be drimped sufficiently to impart suppleness.

It is an object of this invention to solve the above problem, and to provide a nonwoven fabric of soft filaments which can be stably spun at a high-speed take-up speed by high-speed gaseous stream drafting, in which the filaments have large numbers of crimps.

According to the present invention, there is provided a soft nonwoven fabric of filaments, said filaments being composed of crimped bi-component composite filaments composed of (A) a first component composed of (a) 3 to 40% by weight of a propylene/ethylene random copolymer having a melting point, determined from DSC main peaks of 110° to 150° C. and a melt flow rate [ASTM D-1238 (L)] of not more than 15 g/10 minutes and (b) 97 to 60% by weight of polyethylene having a melt flow rate [ASTM D-1238 (E)] of at least 15 g/10 minutes, and (B) a second component comprising crystalline polypropylene having a melt flow rate [ASTM D-1238 (L)] of at least 10 g/10 minutes as a main component.

The propylene/ethylene random copolymer (a) used in the first component (A) has a melting point, measured from the main peaks of DSC (diferential scanning calorimemeter), of 110° to 150° C., preferably 130° to 145° C. and a melt flow rate (MFR) [ASTM D-1238 (L)], of 10 g/10 minutes or less preferably 2 to 7 g/10 min. The ethylene content of this random copolymer is determined by its melting point, but is about 2 to 10 mole %, preferably 3 to 5 mole %. If desired, it may also contain up to 10 mole % of an alpha-olefin having 4 to 8 carbon atoms.

Since the melting point of the propylene/ethylene random copolymer (a) is within the above-mentioned range, the resulting starting material has softness. Further since its MFR is within the above range, its mixability with polyethylene is bettered, and the spinnability of the composition of (A) and (B) is improved. The amount of the propylene/ethylene random copolymer (a) is 3 to 40% by weight, preferably 10 to 30% by weight, based on the entire weight of the first component (A). Within this quantitative range, the mixing of the polymers is improved and the resulting mixture attains a viscosity suitable for spun filaments. The spinnability is therefore increased.

The polyethylene (b) used in the first compnent (A) in this invention has an MFR [ASTM D-1238 (E)] of at least 15 g/10 minutes, preferably at least 20 g/10 minutes, and a density of less than 0.935 g/cm$^3$, preferably 0.915 to 0.930 g/cm$^3$. Examples of such polyethylene are low-density polyethylene and linear low-denisty polyethylene, and the former is preferred.

The low-density polyethylene includes a homopolymer of ethylene produced by the high pressure method, or a copolymer of ethylene with not more than 20 mole %, preferably not more than 10 mole %, of an alpha-olefin having at least 3 carbon atoms, preferably 4 to 20 carbon atoms.

The linear low-density polyethylene resin is a copolymer of ethylene with 0.5 to 40 mole %, preferably 0.5 to 30 mole %, of an alpha-olefin having at least 4 carbon atoms, preferably 4 to 20 carbon atoms. It may be produced by a medium to low pressure method under a pressure of 0 to 100 atmospheres (gauge pressure) using coordination catalysts.

Since the MFR and density of the polyethylene (b) are within the above ranges, stable spinning can be carried out at high take-up speeds. The amount of the polyethylene (b) is 97 to 60% by weight, preferably 90 to 70% by weight, based on the first component (A).

The first component (A) of this invention is a composition obtained by mixing the propylene/ethylene random copolymer (a) and polyethylene (b). Mixing of the propylene/ethylene random copolymer (a) with the polyethylene (b) is mixed by conventional mixing means, for example, by using a Banbury mixer, a hot roll, or an extruder. The mixing may also be carried out by pellet blending in a spinning extruder. The method of mixing is not particularly limited if it can effect intimate mixing.

The polypropylene as the second component (B) in this invention has an MFR [ASTM D-1228 (L)] of at least 10 g/10 minutes, preferably 12 to 40 g/10 minutes. This crystalline polypropylene advantageously has a crystallinity, determined by X-ray diffractometry, of at least 40%, preferably at least 55%. It is a homopolymer of propylene, or a highly crystalline copolymer of propylene with not more than 20 mole %, preferably not more than 10 mole %, of an alpha olefin having 2 or 4 to 20 carbon atoms.

The second component (B) contains such a crystalline polypropylene as a main component and may contain not more than 30% of another polyolefin such as polyethylene or polybutene.

DETAILED DESCRIPTION OF THE DRAWINGS

Figure 1A:
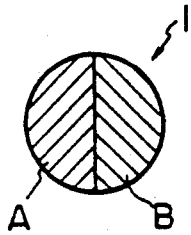
FIG. 1 shows three different fiber cross-sectional distributions of the two components of which the fibers forming the fabrics of the instant case are composed.
Figure 1B:
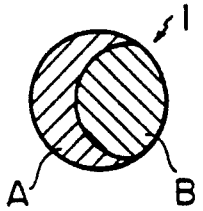
Figure 1C:
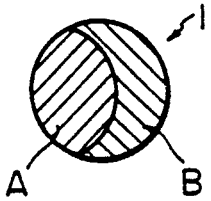

Referring to the accompanying drawings, FIG. 1 (a), (b) and (c) respectively show a sectional view of a filament in the nonwoven fabric of this invention. The filament 1 constituting the nonwoven fabric of this invention is a composite of the first component (A) and the second component (B). As shown in FIG. 1, (a), the first component (A) and the second component (B) constituting the filament 1 may be completely aligned side by side. Or as shown in FIG. 1, (b) or (c), one component may partly cover the other component.

The filaments constituting the nonwoven fabric of this invention are of the above composite structure and in the crimped state. By arranging the first component (A) and the second component (B) side by side and spinning them into a composite structure, crimps occur owing to the difference in shrinkage between the two components. There is no particular limitation on the proportions of the first and the second components. The preferred volume ratio of the component (A) to component (B) is from 20:80 to 70:30, especially preferably from 30:70 to 60:40. The number of crimps is neither restricted in particular. The preferred number of crimps according to JIS L1074 is at least 10/25 mm, preferably at least 30/25 mm.

Figure 2:
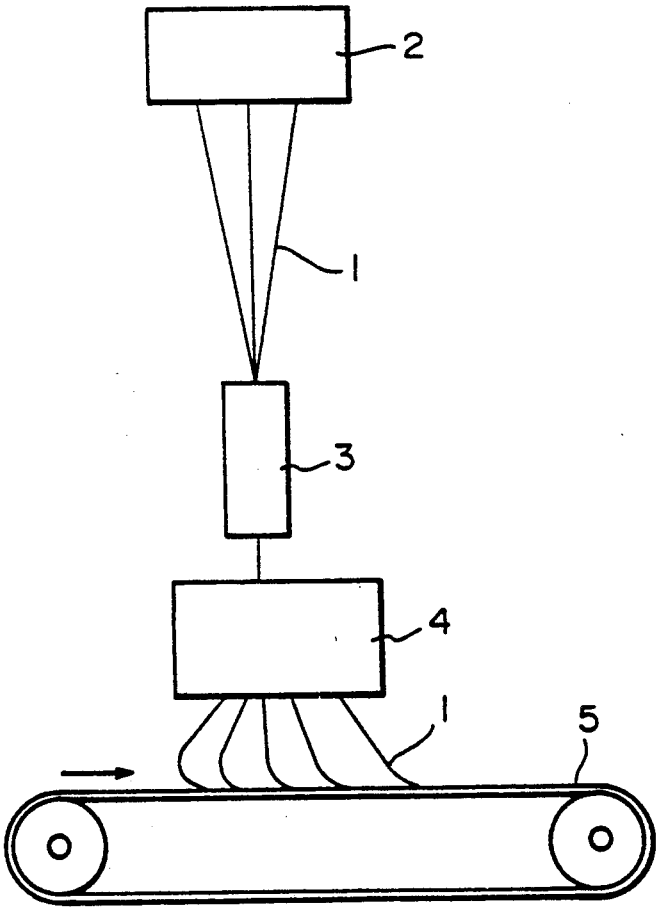
FIG. 2 is a schematic representation of the functioning of the apparatus used to produce the non-woven fabrics of the instant case.

The crimped filaments may be produced into a nonwoven fabric by, for example, using a spun-bonding method comprising taking up the filaments by drafing in a high-speed gaseous stream, for example, by taking advantage of the fact that the filaments used in this invention can be taken up at a high speed. FIG. 2 is a schematic front view of the apparatus for producing the nonwoven fabric of this invention presented to show the method of producing a nonwoven fabric by the spun-bonded method. The production of the nonwoven fabric of this invention starts from spinning molten polymers of the first component and the second component by jetting them out from a nozzle 2 of the side-by-side arrangement type to form filaments 1, placing the filaments 1 on an air stream from a high-speed air stream drafting device 3, and gathering the filaments 1 on a moving and collecting surface while dispersing them by a dispersing plate. The filaments 1 delivered by the moving and collecting surface 5 are sent between a heated embossing roll and a cylindrical roll to heat-fuse the filaments to each other and produce a nonwoven fabric. Otherwise, a nonwoven fabrfic may be produced by passing the filaments 1 through a heating chamber to melt-adhere the filaments to each other, or bond the filaments to each other using an adhesive, or entangling the filaments with each other by needle-punching.

The nonwoven fabric so produced preferably has a monofilament size of 1 to 20 denier preferably 1.5 to 4 denier, and a unit weight (X) of 10 to 200 g/m$^2$, preferably 15 to 120 g/m$^2$.

Since the number of crimps in the filaments is large in the nonwoven fabric of this invention, the nonwoven fabric has a high softness value per unit weight. The softness of the nonwoven fabric is measured in accordance with JIS L-1096. When the advancing direction of the conveyor is taken as the longitudinal direction, the softness of the nonwoven fabric per unit weight (X) (g/m$^2$) is expressed by a geometrical average $\sqrt{S_{MD} \cdot S_{TD}}$ of its softness in the longitudinal direction $S_{MD}$(g) and its softness in the lateral difection is $S_{TD}$(g).

The nonwoven fabric has good softness when the following expression is satisfied.

$$\sqrt{S_{MD} \cdot S_{TD}} \leqq 0.4 \times 10^{(x/50)} \quad [I]$$

Since the nonwoven fabric is composed of a juxtaposed composite of filaments composed of the first component consisting of the propylene/ethylene random copolymer and low-density polyethylene and the second component of crystalline polypropylene, the composite can be stably spun at a high take-up speed of at least 2000 m/min. by high-speed air stream drafting. Furthermore, the number of crimps in the filaments is large, and a soft nonwoven fabric of the filaments can be obtained.

The following examples illustrate the invention more specifically.

EXAMPLE 1

Using a first component composed of 17% by weight of a propylene/ethylene random copolymer having a melting point, determined from main peaks measured at a temperature elevating rate of 10° C./min. by DSC (Perkin Elmer DSC-7), of 140° C. and 83% by weight of low-density polyethylene having an MFR [ASTM D-1238 (E)] of 22 g/10 min. and a density of 0.925 g/cm$^3$ and as a second component, crystalline polypropylene having an MFR [ASTM D-1238 (L)] of 36 g/10 min. and a crystallinity of 60% were extruded through a side-by-side advancing type nozzle having 700 holes at an extrusion rate of 0.88 g/min. per hole. The extrudate was taken up by a high-speed air stream drafting device. The resulting group of filaments were received onto a moving conveyor while they were dispersed by a dispersing plate. The group of filaments were pressurized under heat between a heated embossing roll and a cylindrical roll to produce an unwoven fabric.

The filaments constituting the nonwoven fabric had a denier sise of 2.5 denier, and contained 48 crimps/25 mm. The drafting speed was 2880/min. No filament breakage occurred, and the spinning could be carried out stably.

The softness of the nonwoven fabric was measured and the thickness by the following methods and the results are shown in Table 1.

Thickness: In accordance with JIS L-1096, it was measured under a load of 0.1 g/mm$^3$.

Softness: By the handlemeter method described in JIS L-1096, a test piece having a size of 15×15 cm was prepared, and its softness was measured with a slot width of 20 mm.

COMPARATIVE EXAMPLE 1

A propylene/ethylene random copolymer having a melting point of 134° C. and an MFR [ASTM D-1238 (L)] of 22 g/10 min. was used. Otherwise, the same procedure as in Example 1 was used. Since the blending could not be performed well, filament breakage frequently occurred, a nonwoven fabric of filaments could not be formed.

COMPARATIVE EXAMPLE 2

Linear low-density polyethylene having an MFR [ASTM D-1238 (ED)] of 30 g/10 min. was alone used as the first component. Otherwise, the same procedure as in Example 1 was repeated. The spinnability was good, but the filaments were not crimped. The softness of the resulting product was insufficient as shown in Table 1.

COMPARATIVE EXAMPLE 3

The same procedure as in Example 1 was repeated except that high-density polyethylene having an MFR [ASTM D-1239 (E)] of 20 g/10 mins. and a density of 0.963 g/cm$^3$ was used as the first component. The results are shown in Table 1.

COMPARATIVE EXAMPLE 4

The same procedure as in Example 1 was repeated except that polypropylene having an MFR [ASTM D-1239 (E))] of 12 g/10 mins. and a crystallinity of 63% was used as the first component. The results are shown in Table 1.

TABLE 1

| | | Example 1 | | | | Comparative Example 2 | Comparative Example 3 | Comparative Example 4 | | |
|---|---|---|---|---|---|---|---|---|---|---|
| Unit weight (g/m$^2$) | | 20 | 30 | 50 | 100 | 25 | 25 | 30 | 50 | 100 |
| Thickness (mm) | | 0.2 | 0.3 | 0.4 | 0.6 | 0.2 | 0.2 | 0.3 | 0.4 | 0.6 |
| Softness | MD | 1.2 | 1.8 | 2.9 | 10.3 | 2.3 | 2.1 | 3.9 | 10.4 | 43.2 |
| (g) | TD | 0.9 | 0.8 | 1.4 | 4.9 | 1.2 | 0.9 | 1.3 | 3.7 | 21.7 |
| $\sqrt{S_{MD} \cdot S_{TD}}$ | | 1.0 | 1.2 | 2.0 | 7.1 | 1.7 | 1.4 | 2.3 | 6.2 | 30.6 |

We claim:

1. A soft nonwoven fabric of filaments, said filaments being composed of crimped bi-component composite filaments composed of (A) a first component composed of (a) 3 to 40% by weight of a propylene/ethylene random copolymer having a melting point, determined from DSC main peaks of 110° to 150° C. and a melt flow rate [ASTM D-1238 (L)] of not more than 15 g/10 minutes and (b) 97 to 60% by weight of polyethylene having a melt flow rate [ASTM D-1238 (E)] of at least 15 g/10 minutes, and (B) a second component comprising crystalline polypropylene having a melt flow rate [ASTM D-1238 (L)] of at least 10 g/10 min. as a main component.

2. The nonwoven fabric of claim 1 in which the propylene/ethylene random copolymer is a terpolymer of propylene/ethylene/an alpha-olefin having 4 to 8 carbon atoms.

* * * * *